US009297281B2

(12) United States Patent
Sisson et al.

(10) Patent No.: US 9,297,281 B2
(45) Date of Patent: Mar. 29, 2016

(54) CONCENTRIC CAMSHAFT PHASER FLEX PLATE

(75) Inventors: James Sisson, Locke, NY (US); Christopher J. Pluta, Ithaca, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 178 days.

(21) Appl. No.: 13/641,147

(22) PCT Filed: Apr. 18, 2011

(86) PCT No.: PCT/US2011/032857

§ 371 (c)(1), (2), (4) Date: Oct. 15, 2012

(87) PCT Pub. No.: WO2011/133452

PCT Pub. Date: Oct. 27, 2011

(65) Prior Publication Data

US 2013/0032112 A1 Feb. 7, 2013

Related U.S. Application Data

(60) Provisional application No. 61/327,483, filed on Apr. 23, 2010.

(51) Int. Cl.

| | |
|---|---|
| ***F01L 1/34*** | (2006.01) |
| ***F01L 1/047*** | (2006.01) |
| ***F01L 1/344*** | (2006.01) |

(52) U.S. Cl.

CPC ..... *F01L 1/047* (2013.01); *F01L 1/3442* (2013.01); *F01L 2001/0473* (2013.01); (Continued)

(58) Field of Classification Search

CPC ..... F01L 1/34; F01L 1/34413; F01L 2001/34486; F01L 2001/34489; F01L 2001/34493; F01L 2001/34496; F01L 1/344; F01L 2001/0478

USPC ..... 123/90.15, 90.17, 90.31; 464/93–96, 464/98–99

See application file for complete search history.

(56) References Cited

U.S. PATENT DOCUMENTS

| | | | |
|---|---|---|---|
| 854,426 | A | 5/1907 | Lowry |
| 1,072,622 | A | 9/1913 | Koechlin |

(Continued)

FOREIGN PATENT DOCUMENTS

WO WO 2008028902 A1 * 3/2008

*Primary Examiner* — Thomas Denion
*Assistant Examiner* — Daniel Bernstein
(74) *Attorney, Agent, or Firm* — Helmholdt Law PLC; Thomas D. Helmholdt

(57) ABSTRACT

A variable cam timing apparatus (10) and method of assembly for transmitting rotational torque between a driving rotary member (15*b*) and a driven rotary member (15*a*). The flexible coupling (14) can include an axis of rotation coinciding with, and an outer peripheral edge (14*a*) extending at least partially around, or completely surrounding, a common rotational axis of the driving rotary member (15*b*) and the driven rotary member (15*a*). The flexible coupling (14) including a flexible body (14*b*) having a plurality of apertures (14*c*, 14*d*) formed therein at angularly spaced positions relative to one another for connection therethrough with respect to the driving and the driven rotary members (15*b*, 15*a*) permitting adjustment for perpendicularity and axial misalignment, while maintaining a torsionally stiff coupling between the driving and driven rotary members (15*b*, 15*a*). A cam phaser (22) and concentric camshaft (12) define at least in part the driving rotary member (15*b*) and the driven rotary member (15*a*) for operating a poppet-type valve (64) of an internal combustion engine (66) of a motor vehicle (68).

10 Claims, 7 Drawing Sheets

(52) U.S. Cl.
CPC ..... *F01L 2001/3443* (2013.01); *F01L 2001/34426* (2013.01); *F01L 2001/34469* (2013.01); *F01L 2001/34483* (2013.01); *Y10T 29/49231* (2015.01)

(56) References Cited

U.S. PATENT DOCUMENTS

| | | | | | |
|---|---|---|---|---|---|
| 1,216,307 | A | | 2/1917 | Guthrie | |
| 2,146,547 | A | | 2/1939 | Lundgren | |
| 2,855,767 | A | * | 10/1958 | Ahlen | 464/98 |
| 3,004,409 | A | | 10/1961 | Grey | |
| 4,040,270 | A | | 8/1977 | Chivari | |
| 4,073,161 | A | * | 2/1978 | Bury | 464/99 |
| 4,207,758 | A | | 6/1980 | Stone | |
| 4,464,139 | A | | 8/1984 | Lindenthal | |
| 4,494,495 | A | | 1/1985 | Nakamura et al. | |
| 4,744,783 | A | * | 5/1988 | Downey et al. | 464/99 |
| 4,770,060 | A | | 9/1988 | Elrod et al. | |
| 4,771,742 | A | | 9/1988 | Nelson et al. | |
| 4,861,313 | A | | 8/1989 | Zeiser et al. | |
| 4,997,072 | A | | 3/1991 | Lapthorne | |
| 5,221,232 | A | * | 6/1993 | Nameny | 464/98 |
| 5,417,186 | A | | 5/1995 | Elrod et al. | |
| 5,474,499 | A | | 12/1995 | Olson | |
| 6,131,486 | A | * | 10/2000 | Doman | 74/572.21 |
| 6,155,220 | A | | 12/2000 | Marriott | |
| 6,216,654 | B1 | * | 4/2001 | Regueiro | 123/90.15 |
| 6,257,186 | B1 | | 7/2001 | Heer | |
| 6,311,655 | B1 | | 11/2001 | Simpson et al. | |
| 6,325,722 | B1 | | 12/2001 | Ciotola | |
| 8,453,615 | B2 | * | 6/2013 | Lettmann et al. | 123/90.17 |
| 2002/0128075 | A1 | * | 9/2002 | Ross | 464/98 |
| 2005/0045130 | A1 | | 3/2005 | White et al. | |
| 2006/0042580 | A1 | | 3/2006 | Suga et al. | |
| 2006/0236965 | A1 | * | 10/2006 | Schaefer et al. | 123/90.17 |
| 2008/0045128 | A1 | | 2/2008 | Trueit et al. | |
| 2009/0293823 | A1 | * | 12/2009 | Latz | F01L 1/024 123/90.15 |
| 2010/0089352 | A1 | | 4/2010 | Myers et al. | |
| 2010/0242881 | A1 | * | 9/2010 | Weber | F01L 1/3442 123/90.17 |
| 2012/0186548 | A1 | * | 7/2012 | David et al. | 123/90.17 |

* cited by examiner

CONCENTRIC CAMSHAFT PHASER FLEX PLATE

FIELD OF THE INVENTION

The invention relates to rotational torque transmitted via a flexible coupling for rotary camshafts, wherein the flexible coupling can have a flexible link body connected to circumferentially spaced axially directed pins on a driving rotary member and a driven rotary member, and more particularly, to rotational torque transmitted via a cam phaser and concentric rotary camshafts for operating at least one poppet-type intake or exhaust valve of an internal combustion engine of a motor vehicle.

BACKGROUND

Variable valve-timing mechanisms for internal combustion engines are generally known in the art. For example, see U.S. Pat. No. 4,494,495; U.S. Pat. No. 4,770,060; U.S. Pat. No. 4,771,772; U.S. Pat. No. 5,417,186; and U.S. Pat. No. 6,257,186. Internal combustion engines are generally known to include single overhead camshaft (SOHC) arrangements, dual overhead camshaft (DOHC) arrangements, and other multiple camshaft arrangements, each of which can be a two-valve or a multi-valve configuration. Camshaft arrangements are typically used to control intake valve and/or exhaust valve operation associated with combustion cylinder chambers of the internal combustion engine. In some configurations, a concentric camshaft is driven by a crankshaft through a timing belt, chain, or gear to provide synchronization between a piston connected to the crankshaft within a particular combustion cylinder chamber and the desired intake valve and/or exhaust valve operating characteristic with respect to that particular combustion cylinder chamber. To obtain optimum values for fuel consumption and exhaust emissions under different operating conditions of an internal combustion engine, the valve timing can be varied in dependence on different operating parameters.

A concentric camshaft includes an inner camshaft and an outer camshaft. The two camshafts can be phased relative to each other using a mechanical device, such as a cam phaser, to vary the valve timing Cam phasers require precise tolerances and alignment to function properly. Misalignment between the inner camshaft and the outer camshaft of the concentric camshaft can create problems preventing proper function of the cam phaser. It would be desirable to provide an assembly capable of adapting to misalignment between inner and outer camshafts of a concentric camshaft and a cam phaser.

SUMMARY

The invention can include a flexible coupling between a cam phaser and a concentric camshaft. The flexible coupling can be mounted between a rotor of the cam phaser and an inner camshaft of the concentric camshaft, or between a housing of the rotor and the outer camshaft of the concentric camshaft. The flexible coupling provides a flexible joint to allow for misalignment between the inner camshaft and the outer camshaft of a concentric camshaft. The flexible coupling can adapt to misalignment of the inner camshaft with respect to the outer camshaft of a concentric camshaft. The flexible coupling can be mounted on either a housing of the phaser or a rotor of the phaser. The flexible coupling permits adjustment for perpendicularity, and axial misalignment while maintaining a torsionally stiff coupling between the cam phaser and at least one of the inner camshaft and the outer camshaft of the concentric camshaft.

An assembly can transmit rotational torque between a driving rotary member and a driven rotary member. A flexible coupling can include a flexible body connected by peripherally spaced apart, axially directed pins with respect to the driving rotary member and the driven rotary member. The flexible body can have a plurality of apertures formed therein at angularly spaced positions relative to one another with respect to an axis of rotation of the driving rotary member and the driven rotary member. A first fastener can connect the flexible body through one aperture with respect to the driving rotary member, and a second fastener can connect the flexible body through another aperture with respect to the driven rotary member, such that rotational torque is transmitted between the driving rotary member and driven rotary member through the flexible body, the flexible body permitting adjustment for perpendicularity and axial misalignment, while maintaining a torsionally stiff coupling between the driving rotary member and the driven rotary member.

The flexible coupling can include an axis of rotation coinciding with, and an outer peripheral edge extending at least partially around, or completely surrounding, a common rotational axis of the driving rotary member and the driven rotary member. The flexible coupling can include a flexible body having a plurality of apertures formed therein at angularly spaced and/or radially spaced positions relative to one another for connection therethrough with respect to the driving rotary member and the driven rotary member, such that rotational torque is transmitted between the driving rotary member and driven rotary member through the flexible body, the flexible body permitting adjustment for perpendicularity and axial misalignment, while maintaining a torsionally stiff coupling between the driving rotary member and the driven rotary member.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
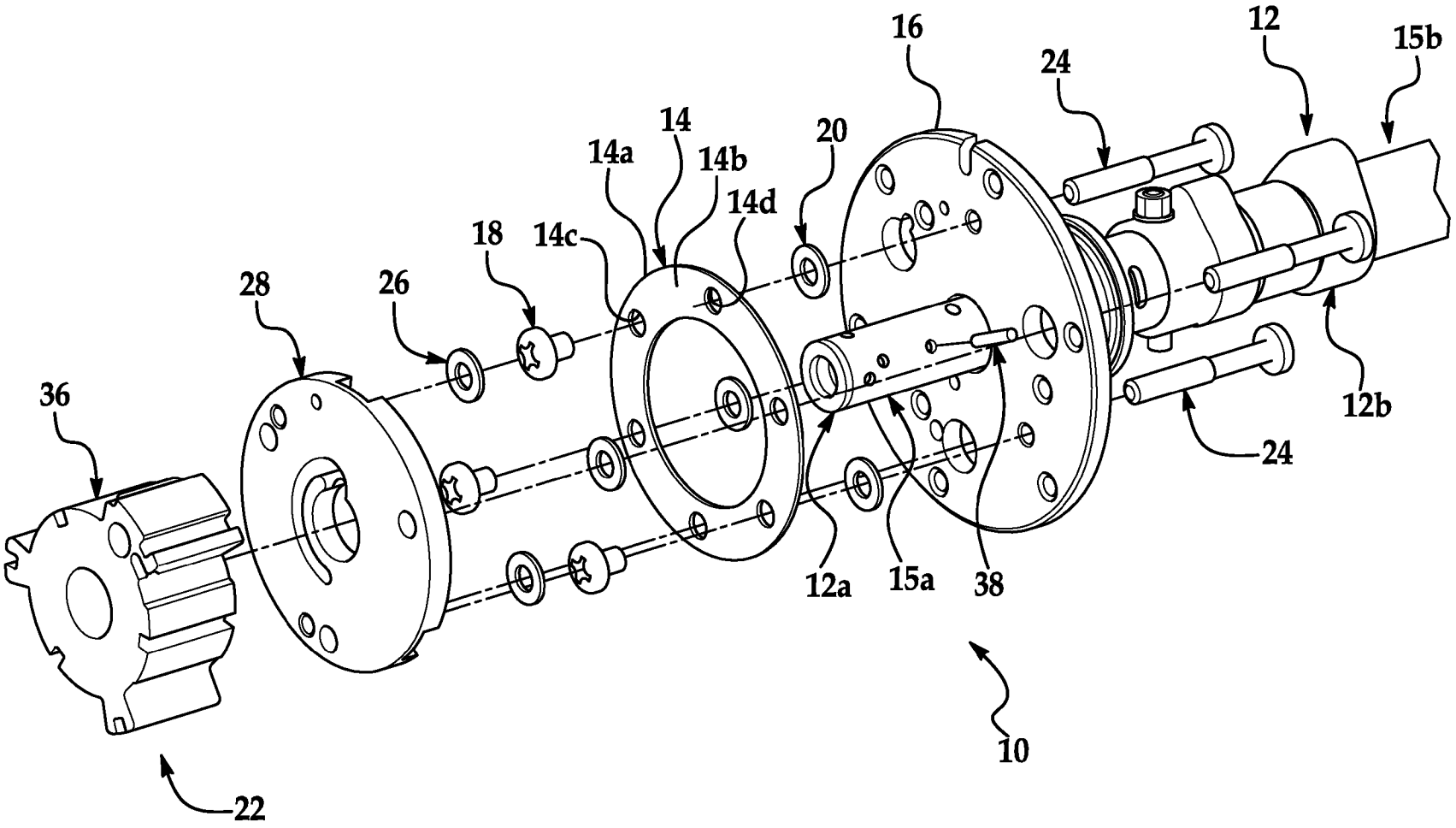
FIG. 1 is a detailed exploded view of a partial cam phaser and a concentric camshaft assembly including a housing, a rotor, a flexible coupling, and the concentric camshaft including an inner camshaft and an outer camshaft.
Figure 2:
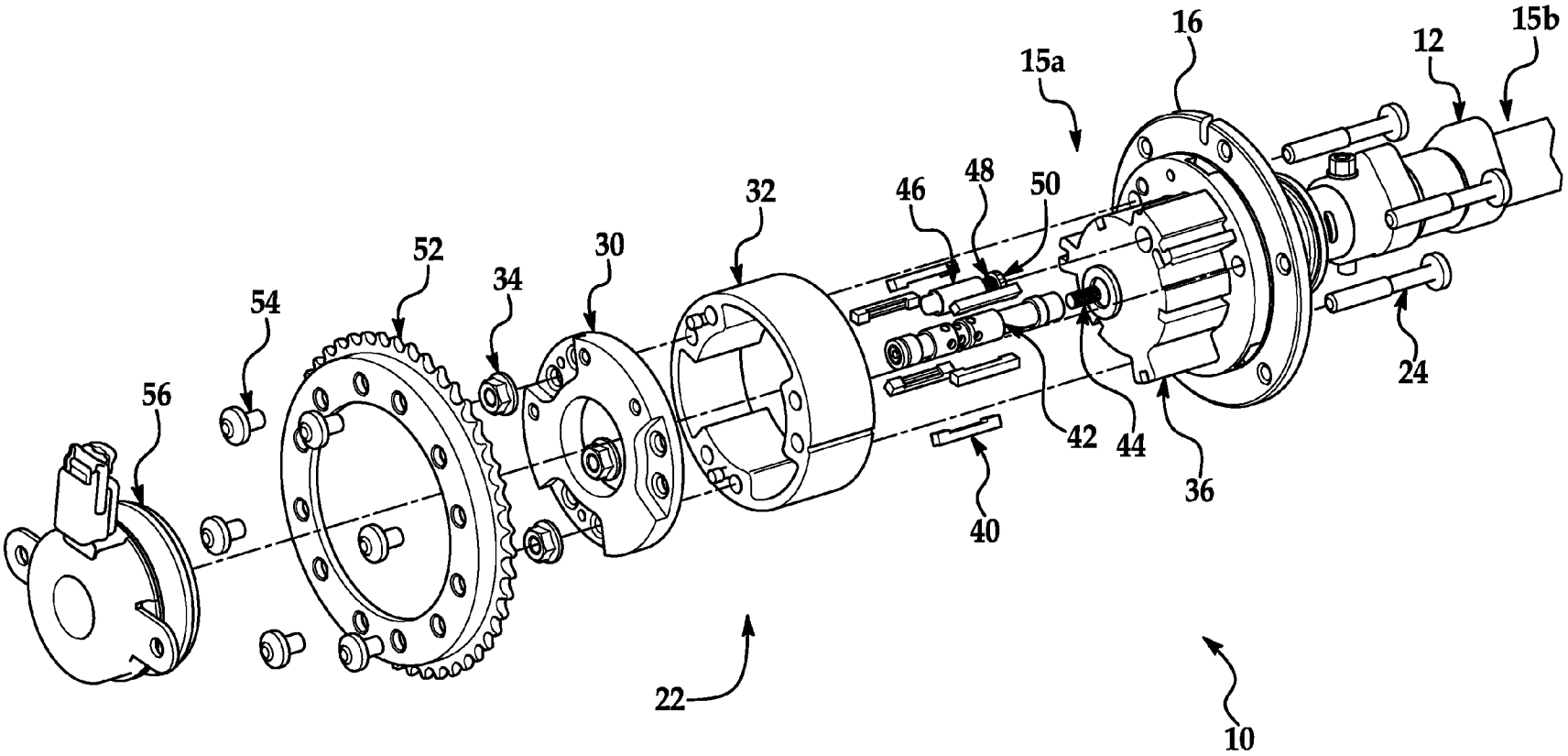
FIG. 2 is a detailed exploded view including the cam phaser and a concentric camshaft assembly of FIG. 1 partially assembled.

Referring now to FIGS. 1-2, a portion of a variable cam timing (VCT) assembly 10 is illustrated including a concentric camshaft 12 having an inner camshaft 12*a* and an outer camshaft 12*b*. Primary rotary motion can be transferred to the concentric camshaft 12 through the assembly of sprocket ring 52 to annular flange 16 operably associated with outer camshaft 12*b*. Secondary rotary motion, or phased relative rotary motion between inner camshaft 12*a* and outer camshaft 12*b*, can be provided by a cam phaser or other mechanical actuator 22. Cam phasers 22 require precise tolerances and alignment to function properly. Misalignment between the inner camshaft 12*a* and the outer camshaft 12*b* of the concentric camshaft 12 can create problems preventing proper function of the cam phaser 22. A flexible coupling 14 can be provided to compensate for misalignment between inner camshaft 12*a* and outer camshaft 12*b* of the concentric camshaft 12 and cam phaser 22. An annular flange 16 can be operably associated with the outer camshaft 12*b*. A flexible coupling 14 can be connected to the annular flange 16 by at least one threaded fastener 18 passing through an aperture 14*d* in a body 14*b* of the flexible coupling 14 and a washer 20, before being threaded into annular flange 16. A mechanical actuator or cam phaser 22 can be operably associated with an inner camshaft 12*a*. From an opposite side of the flexible coupling 14, the flexible coupling 14 can be connected to the actuator 22 by at least one threaded fastener 24 passing through an aperture 14*c* in the body 14*b* of the flexible coupling 14, a washer 26, an inner plate 28 bearing on inner camshaft 12*a*, a housing 32, and an outer plate 30, before being secured by a nut 34 as best seen in the FIGS. 1 and 2, by way of example and not limitation, such as for an exhaust camshaft. A rotor 36 can be pressed onto the inner camshaft 12*a* and secured with a pin 38. The rotor 36 can be housed between the inner plate 28, the housing 32, and the outer plate 30.

Figure 3:
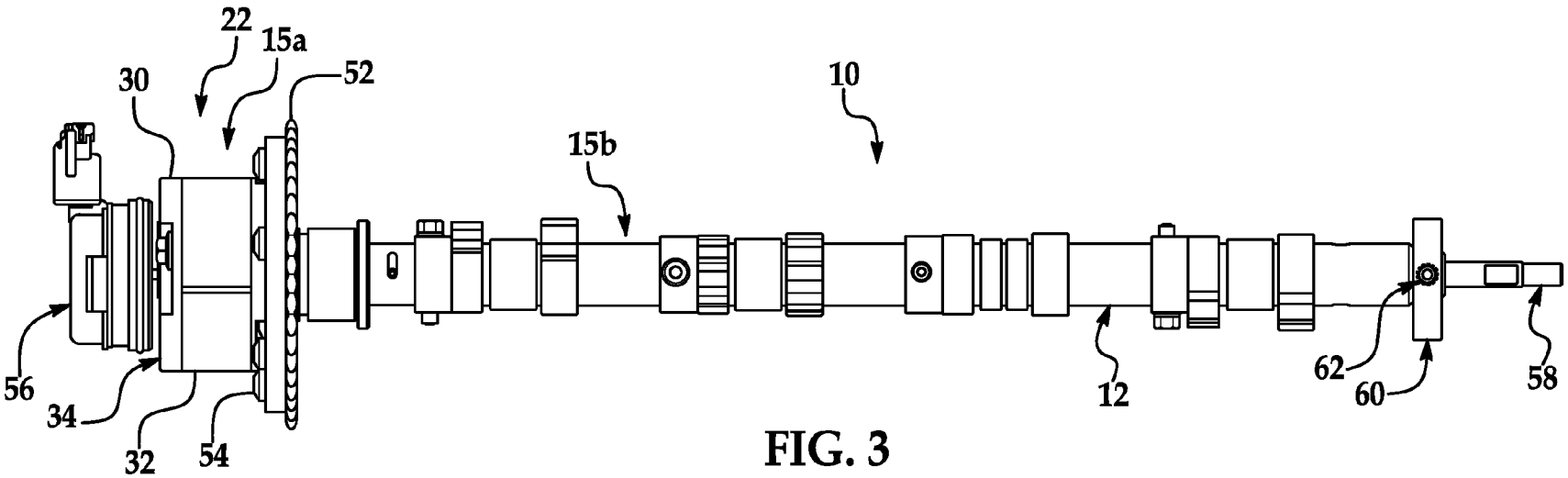
FIG. 3 is a side view of the cam phaser and a concentric camshaft assembly illustrating the cam phaser connected to the concentric camshaft having cam lobes for engaging poppet-type valves of an internal combustion engine of a motor vehicle.
Figure 4:
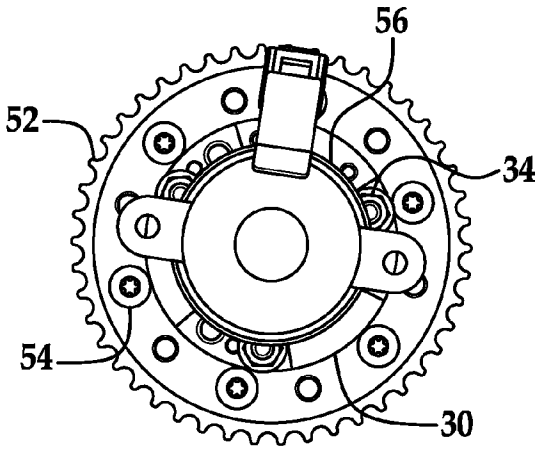
FIG. 4 is an end view of the cam phaser and a concentric camshaft assembly.

Referring now to FIG. 2, the rotor 36 can include vane tip seals 40 and vane tip seal springs (not shown). A spool valve assembly 42 and spool valve spring 44 can be positioned within the rotor 36. A lock pin 46 and lock pin spring 48 can be assembled within the rotor 36 and held in place by a lock pin plug 50. Referring now to FIGS. 2 and 4, the sprocket ring 52 can be assembled to the annular flange 16 by fasteners 54 to define a driving rotary member 15*b* assembly associated with outer camshaft 12*b*. A solenoid 56 can be connected to the outer plate 30 of the exhaust camshaft housing 32. Referring now to FIG. 3, an encoder shaft 58 can be connected to an end of the concentric camshaft 12 opposite from the actuator 22. A cam sensor position wheel 60 can be connected with a set screw 62 to the concentric camshaft 12 positioned adjacent the encoder shaft 58.

Referring now to FIGS. 1-4, an assembly 10 is disclosed for transmitting rotational torque between a driving rotary member 15*b* and a driven rotary member 15*a*, wherein a flexible coupling 14 includes an axis of rotation coinciding with, and an outer peripheral edge 14*a* at least partially extending around a common rotational axis of the driving rotary member 15*b* and the driven rotary member 15*a*. The flexible coupling 14 can include a flexible body 14*b* having a plurality of apertures 14*c*, 14*d* formed therein at angularly spaced positions relative to one another for connection therethrough with respect to the driving rotary member 15*b* and the driven rotary member 15*a*, such that rotational torque is transmitted between the driving rotary member 15*b* and driven rotary member 15*a* through the flexible body 14*b*. The flexible body 14*b* permits adjustment for perpendicularity and axial misalignment, while maintaining a torsionally stiff coupling between the driving rotary member 15*b* and the driven rotary member 15*a*.

Figure 6:
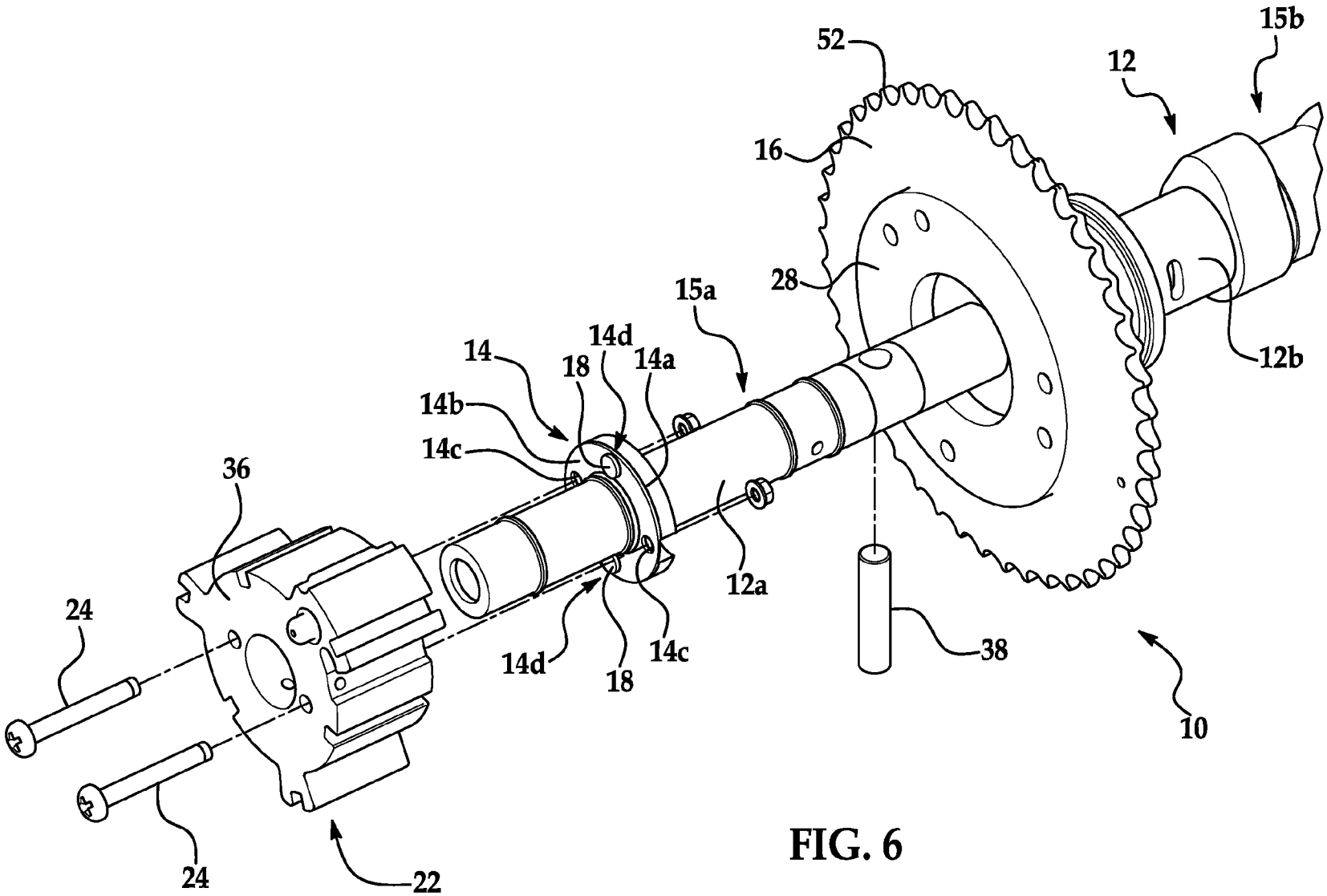
FIG. 6 is an exploded detail view of a portion of a cam phaser and a concentric camshaft assembly including a rotor, a flexible coupling, and the concentric camshaft including an inner camshaft and an outer camshaft.

Referring now to FIG. 6, the assembly 10 can transmit rotational torque between a driving rotary member 15*b*, by way of example and not limitation such as rotor 36, and a driven rotary member 15*a*, such as inner camshaft 12*a*, wherein a flexible coupling 14 includes an axis of rotation coinciding with, and an outer peripheral edge 14*a* extending at least partially around a common rotational axis of the driving rotary member 15*b*, such as rotor 36, and the driven rotary member 15*a*, such as inner camshaft 12*a*. The flexible coupling 14 can include a flexible body 14*b* having a plurality of apertures 14*c*, 14*d* formed therein at angularly spaced positions relative to one another for connection therethrough with respect to the driving rotary member 15*b*, such as rotor 36, and the driven rotary member 15*a*, such as inner camshaft 12*a*, such that rotational torque is transmitted between the driving rotary member 15*b*, such as rotor 36, and driven rotary member 15*a*, such as inner camshaft 12*a*, through the flexible body 14*b*. The flexible body 14*b* permits adjustment for perpendicularity and axial misalignment, while maintaining a torsionally stiff coupling between the driving rotary member 15*b*, such as rotor 36, and the driven rotary member 15*a*, such as inner camshaft 12*a*. At least one driving fastener 24 can be engageable through one of the plurality of apertures 14*c* in the flexible body 14*b* to connect with respect to the driving rotary member 15*b*, such as rotor 36, and at least one driven fastener 18 can be engageable through another of the plurality of apertures 14*d* in the flexible body 14*b* to connect with respect to the driven rotary member 15*a*, such as inner camshaft 12*a*.

Referring again to FIGS. 1-4, the flexible body 14*b* can have a plate shape with a relatively small axial dimension along a rotational axis relative to a larger radial dimension of the flexible body 14*b*. The flexible body 14*b* can have a radially extending plate shape with an axially extending disc or cylindrical shaped peripheral surface 14*a*. A cam phaser or mechanical actuator 22 can include a housing 28, 30, 32 at least partially enclosing a rotor 36. A concentric camshaft 12 can include an inner camshaft 12*a* and an outer camshaft 12*b*, one camshaft 12*a* or 12*b* defining a driven rotary member 15*a*, and the other camshaft 12*b* or 12*a* associated with a driving rotary member 15*b*. The flexible body 14*b* can be connected between at least a portion of the cam phaser 22 and at least a portion of the concentric camshafts 12. As illustrated in FIGS. 1-4, the flexible body 14*b* can be connected between the housing portion 28 of the cam phaser 22 and the flange 16 associated with the outer camshaft 12*b* of the concentric camshafts 12. At least one driving fastener 24 can be engageable through one of the plurality of apertures 14*c* in the flexible body 14*b* to connect with respect to the driving rotary member 15*b*, by way of example and not limitation such as the flange 16 associated with the outer camshaft 12*b*, and at least one driven fastener 18 can be engageable through another of the plurality of apertures 14*d* in the flexible body 14*b* to connect with respect to the driven rotary member 15*a*, by way of example and not limitation such as inner camshaft 12*a* through housing portion 28 of cam phaser 22 enclosing rotor 36 associated with inner camshaft 12*a*. This locates the flexible body 14*b* of the flexible coupling 14 between the flange 16 connected to the outer camshaft 12*b* and the housing 28, 30, 32 of the cam phaser 22, where the rotor 36 located within the housing 28, 30, 32 is connected to the inner camshaft 12*a*.

Figure 5:
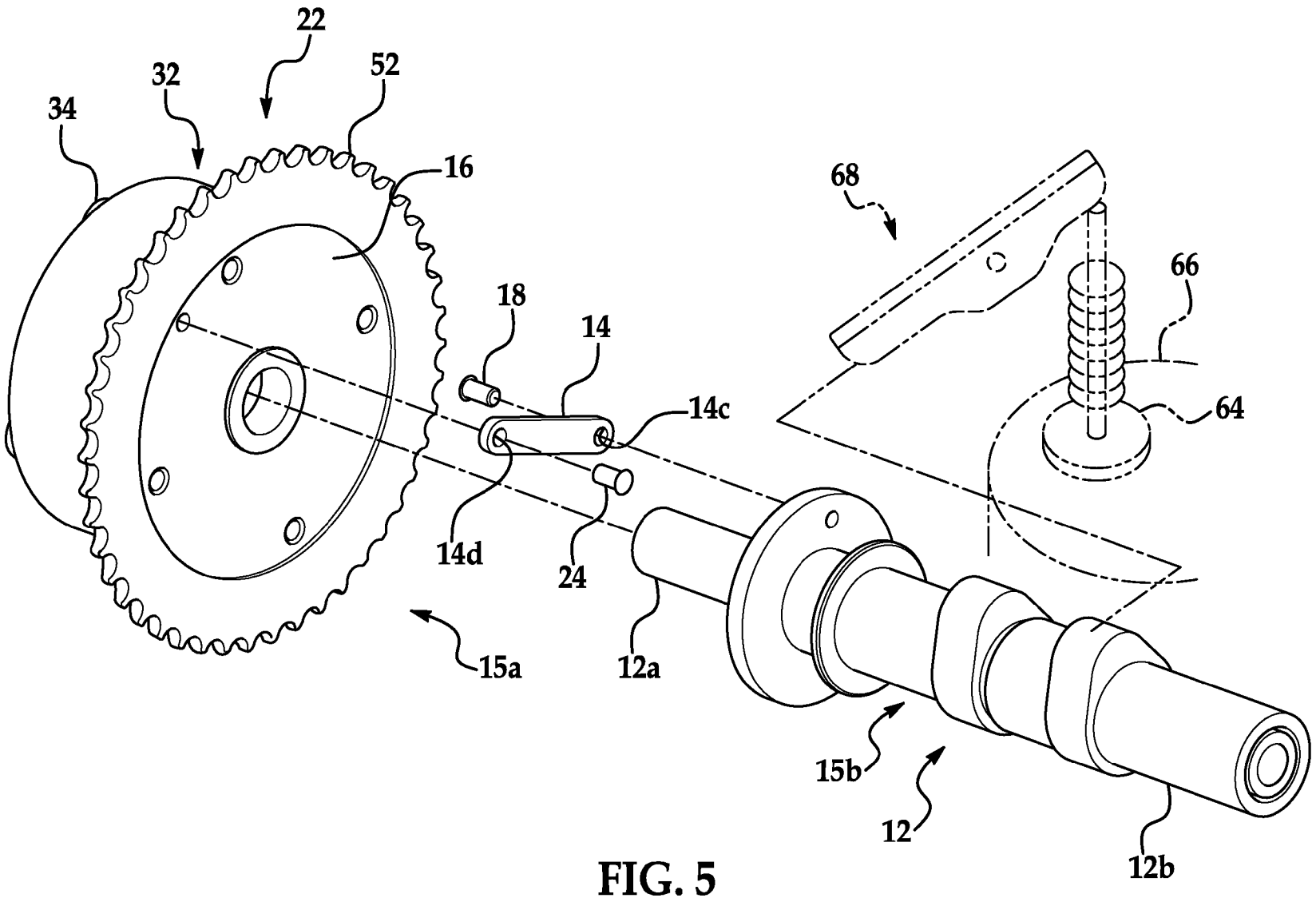
FIG. 5 is an exploded view of a cam phaser and a concentric camshaft assembly including a housing enclosing a rotor, a flexible coupling, and the concentric camshaft including an inner camshaft and an outer camshaft.

Referring again to FIG. 6, the flexible body 14*b* can be connected between the rotor 36 of the cam phaser 22 and the inner camshaft 12*a* of the concentric camshafts 12. In other words, the flexible coupling 14 can be positioned between the driving rotary member 15*b*, and the driven rotary member 15*a*, either between the cam phaser assembly 22, such as rotor 36 and the inner camshaft 12*a* as illustrated in FIG. 5, or between the cam phaser assembly 22, such as housing portion 28 and the outer camshaft 12*b*, as illustrated in FIGS. 1-4. In FIGS. 1-4, by way of example and not limitation, driving rotary member 15*b* can include an assembly of the flange 16, the sprocket ring 52, and the outer camshaft 12*b*, while driven rotary member 15*a* can include an assembly of the cam phaser 22 including the rotor 36, the outer end plate 30, the housing 32, and the inner plate 28, where the inner camshaft 12*a* is pinned to rotor 36 and the flexible coupling 14 is located between the inner plate 28 of cam phaser 22 and the flange 16 connected to outer camshaft 12*b*. In FIG. 6, by way of example and not limitation, driving rotary member 15*b* can include an assembly of the flange 16, the sprocket ring 52, the inner plate 28, housing 32, outer plate 30, and rotor 36, while the driven rotary member 15*a* can include the inner camshaft 12*a*, where the inner camshaft 12*a* is connected to the flexible coupling 14 and the flexible coupling is connected to the rotor 36. In other words, the flexible coupling 14 can be located between the outer camshaft 12*b* and the cam phaser 22 as illustrated in FIG. 1-4, or as illustrated in FIG. 6 the flexible coupling 14 can be located between the inner camshaft 12*a* and the cam phaser 22.

In a variable cam timing assembly 10 for an internal combustion engine of a motor vehicle, a flexible coupling 14 transmits rotational torque between a driving rotary member 15*b* and a driven rotary member 15*a*. The flexible coupling 14 includes an axis of rotation coinciding with, and an outer peripheral edge 14*a* extending at least partially around a common rotational axis of the driving rotary member 15*b* and the driven rotary member 15*a*. The flexible coupling 14 can include a flexible body 14*b* having a plurality of apertures 14*c*, 14*d* formed therein at angularly spaced positions relative to one another for connection therethrough with respect to the driving rotary member 15*b* and the driven rotary member 15*a*, such that rotational torque is transmitted between the driving rotary member 15*b* and the driven rotary member 15*a* through the flexible body 14*b*. The flexible body 14*b* permitting adjustment for perpendicularity and axial misalignment, while maintaining a torsionally stiff coupling between the driving rotary member 15*b* and the driven rotary member 15*a*.

In a variable cam timing assembly 10 for operating at least one poppet-type valve of an internal combustion engine of a motor vehicle, a flexible coupling 14 transmits rotational torque between concentric camshafts 12 including an inner rotary camshaft 12*a* defining at least in part driven rotary member 15*a* and an outer rotary camshaft 12*b* defining at least in part a driving rotary member 15*b*. The flexible coupling 14 includes an axis of rotation coinciding with, and an outer peripheral edge 14*a* extending at least partially around a common rotational axis of the driving rotary member 15*b* and the driven rotary member 15*a*. The flexible coupling 14 can include a flexible body 14*b* having a plurality of apertures 14*c*, 14*d* formed therein at angularly spaced positions relative to one another for connection therethrough with respect to the driving rotary member 15*b* and the driven rotary member 15*a*, such that rotational torque is transmitted between the driving rotary member 15*b* and the driven rotary member 15*a* through the flexible body 14*b*. The flexible body 14*b* permits adjustment for perpendicularity and axial misalignment, while maintaining a torsionally stiff coupling between the driving rotary member 15*b* and the driven rotary member 15*a*. At least one driving fastener 18 is engageable through one of the plurality of apertures 14*d* in the flexible body 14*b* to be connected with respect to the driving rotary member 15*b*, and at least one driven fastener 24 is engageable through another of the plurality of apertures 14*c* in the flexible body 14*b* to be connected with respect to the driven rotary member 15*a* through cam phaser housing 28, 30, 32 enclosing rotor 36.

Referring now to FIG. 5, a variable cam timing assembly 10 is illustrated for operating at least one poppet-type valve 64 of an internal combustion engine 66 of a motor vehicle 68. A flexible coupling 14 transmits rotational torque between concentric camshafts 12 including an inner rotary camshaft 12*a* and an outer rotary camshaft 12*b*. The concentric camshafts 12 define at least in part a driving rotary member 15*b* and a driven rotary member 15*a*. A cam phaser 22 can have a housing 28, 30, 32 at least partially enclosing a rotor 36. The flexible coupling 14 can include a flexible body 14*b* having a plurality of apertures 14*c*, 14*d* formed therein at angularly spaced positions relative to one another with respect to an axis of rotation of the concentric camshafts 12. A fastener 18, 24 for each aperture 14*c*, 14*d* can operably extend therethrough in opposite axial directions for connection with respect to a corresponding one of the driving rotary member 15*b* and the driven rotary member 15*a*. In other words, the flexible coupling 14 can have a flexible body 14*b* connected to circumferentially spaced axially directed pins or fasteners 18, 24 on a driving rotary member 15*b* and a driven rotary member 15*a*. The flexible body 14*b* can be connected between at least a portion of the cam phaser 22 and at least a portion of the concentric camshafts 12, such that rotational torque is transmitted between the driving rotary member 15*b* and the driven rotary member 15*a* through the flexible body 14*b*. The flexible body 14*b* permits adjustment for perpendicularity and axial misalignment, while maintaining a torsionally stiff coupling between the driving rotary member 15*b* and the driven rotary member 15*a*. The flexible coupling 14 can also include an axis of rotation coinciding with a common rotational axis of the driving rotary member 15*b* and the driven rotary member 15*a*. As illustrated in FIGS. 1-4 and 6-13, the flexible coupling 14 can include an outer peripheral edge 14*a* completely surrounding the common rotational axis of the driving rotary member 15*b* and the driven rotary member 15*a*, by way of example and not limitation, such as concentric camshaft 12 including inner camshaft 12*a* and outer camshaft 12*b*. As illustrated in FIG. 5, the flexible coupling 14 can include a planar shape or non-planar shape configuration, with a straight link, or a bent link, or an arcuate link. The flexible coupling 14 can be formed of one or more flexible bodies 14*b*. The flexible coupling 14 can extend at least partially around, or can completely surround, the rotational axes of the driving rotary member 15*b* and the driven rotary member 15*a*.

In any of the illustrated configurations, the flexible coupling 14 can be formed of one or more flexible bodies 14*b*. The flexible body 14*b* can be formed in a planar shape or a non-planar shape. The flexible body 14*b* can have a straight link shape, or bent link shape, or an at least partially arcuate link shape depending on the requirements of the particular application. In any case, the axial thickness of the material defining the flexible body 14*b*, as opposed to the overall axial dimension of a non-planar configuration of the flexible body 14*b*, is relatively small in comparison to the radial or circumferential dimensions of the flexible body 14*b* in order to provide the inherent flexibility characteristics desired in the flexible body 14*b*.

In operation, primary rotary motion is transferred to the concentric camshaft 12 through the driving rotary member 15*b*, by way of example and not limitation, such as an assembly of the sprocket ring 52 to the annular flange 16 which is operably associated or connected with the outer camshaft 12*b* of the concentric camshaft 12. Secondary rotary motion, or phased relative rotary motion between the inner camshaft 12*a* and the outer camshaft 12*b*, is provided by a cam phaser or other mechanical actuator 22. The flexible coupling 14 and cam phaser 22 are connected between the driven rotary member 15*a*, by way of example and not limitation, such as an assembly including the inner camshaft 12*a*, and the driving rotary member 15*b*, by way of example and not limitation, such as an assembly including the outer camshaft 12*b*. The flexible coupling 14 can be located, either before the cam phaser 22 or after the cam phaser 22, with respect to the driving rotary member 15*b* and driven rotary member 15*a*. If the flexible coupling 14 is located before the cam phaser 22, the flexible coupling can be connected to the driving rotary member 15*b*, such as through annular flange 16 and sprocket ring 52, and can also be connected to the cam phaser 22, such as through a portion of the cam phaser housing assembly 28, 30, 32. If the flexible coupling 14 is located after the cam phaser 22, the flexible coupling 14 can be connected to the driving rotary member 15*b*, such as through rotor 36 of cam phaser 22, and can also be connected to the driven rotary member 15*a*, such as inner camshaft 12*a*. In either case, the flexible coupling 14 provides a flexible joint to allow for misalignment between the inner camshaft 12*a* and the outer camshaft 12*b* of a concentric camshaft 12. The flex coupling 14 can adapt to misalignment of the inner camshaft 12*a* with respect to the outer camshaft 12*b* of the concentric camshaft 12. The flex coupling 14 permits adjustment for perpendicularity, and axial misalignment while maintaining a torsionally stiff coupling between the cam phaser 22 and at least one of the inner camshaft 12*a* and the outer camshaft 12*b* of the concentric camshaft 12.

Figure 7:
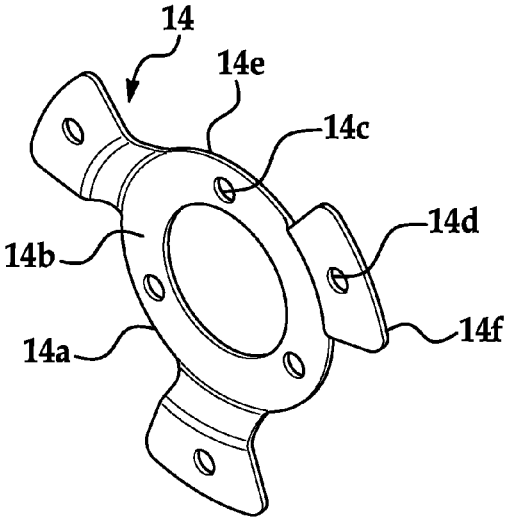
FIG. 7 is a front perspective view of a non-planar flexible coupling having an inner annular flange and radially outwardly extending non-planar tabs, the flexible coupling further having radially and angularly spaced apertures for connection between the driving rotary member and the driven rotary member.
Figure 8:
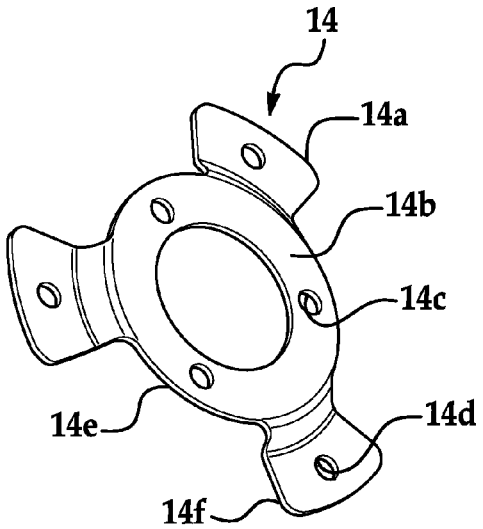
FIG. 8 is a rear perspective view of the non-planar flexible coupling of FIG. 7.
Figure 9:
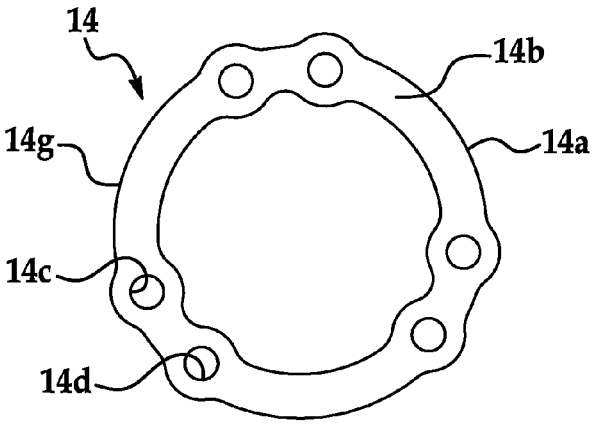
FIG. 9 is a plan view of a flexible coupling having an annular flange with irregularly angularly spaced apertures for connection between the driving rotary member and the driven rotary member.
Figure 10:
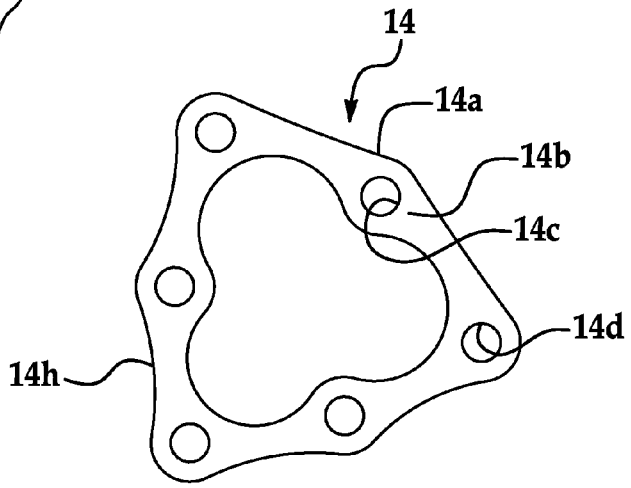
FIG. 10 is a plan view of a flexible coupling having a generally triangular configuration with radially and angularly spaced apertures for connection between the driving rotary member and the driven rotary member.
Figure 11:
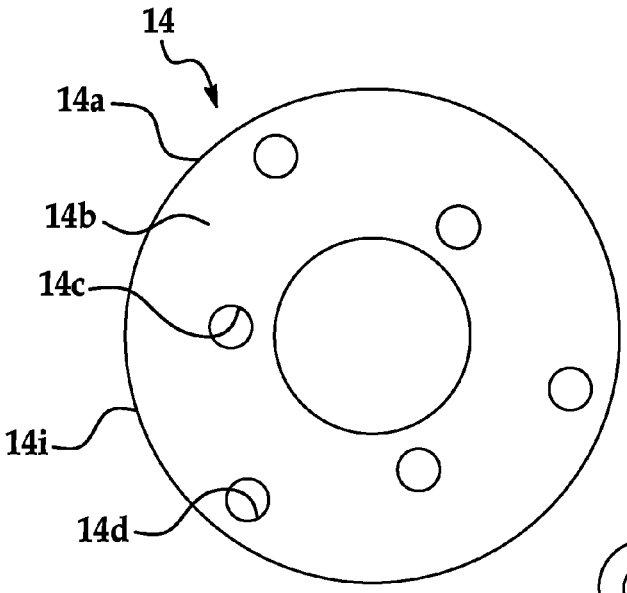
FIG. 11 is a plan view of a flexible coupling having an annular flange with radially and angularly spaced apertures for connection between the driving rotary member and the driven rotary member.
Figure 12:
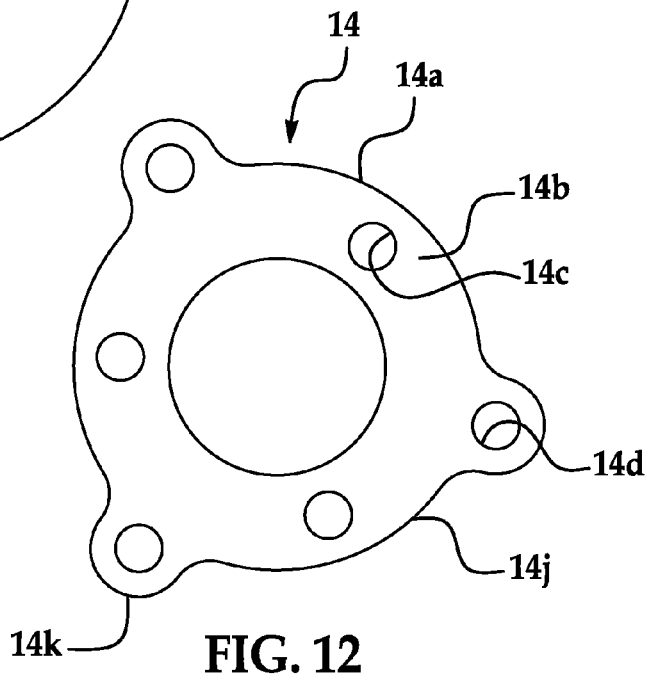
FIG. 12 is a plan view of a flexible coupling having an annular flange with radially outwardly extending tabs, the flexible coupling further having radially and angularly spaced apertures for connection between the driving rotary member and the driven rotary member.
Figure 13:
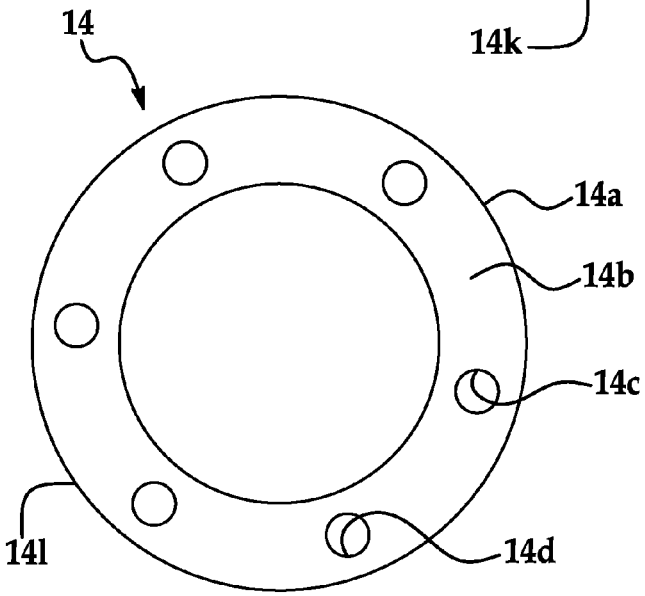
FIG. 13 is a plan view of a flexible coupling having an annular flange with angularly spaced apertures for connection between the driving rotary member and the driven rotary member.

Referring now to FIGS. 7-13, the flexible coupling 14 can take a variety of shapes and forms. FIG. 7 illustrates a front perspective view of a non-planar flexible coupling 14 having a flexible body 14*b* with an inner annular flange 14*e* and radially outwardly extending non-planar tabs 14*f* defining peripheral edge 14*a*. The flexible coupling 14 can further have radially and angularly spaced apertures 14*c*, 14*d* for connection between the driving rotary member 15*b* and the driven rotary member 15*a*. FIG. 8 illustrates a rear perspective view of the non-planar flexible coupling 14 of FIG. 7. FIG. 9 depicts a plan view of a flexible coupling 14 having a flexible body 14*b* with a peripheral edge 14*a* defined by an annular flange 14*g* with irregularly angularly spaced apertures 14*c*, 14*d* for connection between the driving rotary member 15*b* and the driven rotary member 15*a*. FIG. 10 shows a plan view of a flexible coupling 14 having a flexible body 14*b* with a peripheral edge 14*a* defined by a generally triangular shaped flange 14*h* with radially and angularly spaced apertures 14*c*, 14*d* for connection between the driving rotary member 15*b* and the driven rotary member 15*a*. FIG. 11 is a plan view of a flexible coupling 14 having a flexible body 14*b* with a peripheral flange 14*a* defined by an annular flange 14*i* with radially and angularly spaced apertures 14*c*, 14*d* for connection between the driving rotary member 15*b* and the driven rotary member 15*a*. FIG. 12 illustrates a plan view of a flexible coupling 14 having a flexible body 14*b* with a peripheral edge 14*a* defined by an annular flange 14*j* with radially outwardly extending tabs 14*k*. The flexible coupling 14 can further have radially and angularly spaced apertures 14*c*, 14*d* for connection between the driving rotary member 15*b* and the driven rotary member 15*a*. FIG. 13 depicts a plan view of a flexible coupling 14 having a flexible body 14*b* with a peripheral edge 14*a* defined by an annular flange 14*l* with angularly spaced apertures 14*c*, 14*d* for connection between the driving rotary member 15*b* and the driven rotary member 15*a*.

It should be recognized that in the configurations illustrated in FIGS. 1-13, the flexible coupling 14 can be either a single unitary piece, or an assembly of multiple pieces, or a plurality of individual pieces working in unison when assembled to the driving rotary member 15*b* and driven rotary member 15*a* without departing from the scope of this disclosure. It should further be recognized that the term driven rotary member 15*a* as used herein is not to be considered limited to an inner concentric camshaft 12*a*, but to include any component operably associated with or assembled to the driven rotary member 15*a*. It should also be recognized that the flexible coupling 14 can be any desired shape or configuration and is not to be considered limited to the specific geometric shapes and configurations illustrated.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a variable cam timing assembly (10) for an internal combustion engine of a motor vehicle having a cam phaser (22) connected between an inner camshaft (12*a*) and an outer camshaft (12*b*) of a concentric camshaft (12), the improvement comprising:

a flexible coupling (14) connected between the cam phaser (22) and at least one of the inner and outer camshafts (12*a*, 12*b*) of the concentric camshaft (12) for transmitting rotational torque, the flexible coupling (14) having a single unitary flexible body (14*b*) permitting adjustment for perpendicularity and axial misalignment, while maintaining a torsionally stiff coupling between the cam phaser (22) and at least one of the inner and outer camshafts (12*a*, 12*b*) of the concentric camshaft (12), wherein the single unitary flexible body (14*b*) has a radially extending non-planar shape with a peripheral surface (14*a*).

2. The improvement of claim 1, wherein the single unitary flexible body (14*b*) is connected between a housing (28, 30, 32) of the cam phaser (22) and the outer camshaft (12*b*) of the concentric camshafts (12).

3. The improvement of claim 1, wherein the single unitary flexible body (14*b*) is connected between a rotor (36) of the cam phaser (22) and the inner camshaft (12*a*) of the concentric camshafts (12).

4. The improvement of claim 1, wherein the single unitary flexible body (14*b*) has an outer peripheral edge (14*a*) extending at least partially around a common rotational axis of the inner and outer camshafts (12*a*, 12*b*) of the concentric camshaft (22), the flexible coupling (14) having an axis of rotation coinciding with the common rotational axis of the inner and outer camshafts (12*a*, 12*b*).

5. The improvement of claim 1, wherein the single unitary flexible body (14*b*) has an outer peripheral edge (14*a*) completely surrounding a common rotational axis of the inner and outer camshafts (12*a*, 12*b*) of the concentric camshaft (22), the flexible coupling (14) having an axis of rotation coinciding with the common rotational axis of the inner and outer camshafts (12*a*, 12*b*).

6. In a variable cam timing assembly (10) for operating at least one poppet-type valve of an internal combustion engine of a motor vehicle including a cam phaser (22) having a housing (28, 30, 32) at least partially enclosing a rotor (36) with an axis of rotation connected to a concentric camshaft (12) including an inner rotary camshaft (12*a*) and an outer rotary camshaft (12*b*), the improvement comprising:

a flexible coupling (14) connected between the cam phaser (22) and at least one of the inner and outer rotary camshafts (12*a*, 12*b*) of the concentric camshaft (12) for transmitting rotational torque therebetween, the flexible coupling (14) having a single unitary flexible body (14*b*) permitting adjustment for perpendicularity and axial misalignment, while maintaining a torsionally stiff coupling between the cam phaser (22) and the concentric camshaft (12), wherein the single unitary flexible body (14*b*) includes a monolithic member connectible at a first radial distance defining at least one first connection point and connectible at a second radial distance defining at least one second connection point, wherein the monolithic member includes a generally triangular-shaped coupling member having the first radial distance at each apex and the second radial distance adjacent midpoints of each side of the generally triangular-shaped coupling member, wherein the first radial distance is greater than the second radial distance.

7. The improvement of claim 6, wherein the flexible coupling (14) includes an axis of rotation coinciding with, and an outer peripheral edge (14*a*) extending at least partially around a common rotational axis of the cam phaser (22) and the concentric camshaft (12).

8. The improvement of claim 6, wherein the single unitary flexibly body (14*b*) has a plurality of apertures (14*c*, 14*d*) formed therein at spaced positions relative to one another for connection therethrough with respect to at least a portion of the cam phaser (22) and at least a portion of the concentric camshaft (12).

9. In a variable cam timing assembly (10) for operating at least one poppet-type valve of an internal combustion engine of a motor vehicle including a cam phaser (22) having a housing (28, 30, 32) at least partially enclosing a rotor (36) with an axis of rotation connected to a concentric camshaft (12) including an inner rotary camshaft (12*a*) and an outer rotary camshaft (12*b*), the improvement comprising:

a flexible coupling (14) connected between the cam phaser (22) and at least one of the inner and outer rotary camshafts (12*a*, 12*b*) of the concentric camshaft (12) for transmitting rotational torque therebetween, the flexible coupling (14) having a single unitary flexible body (14*b*) permitting adjustment for perpendicularity and axial misalignment, while maintaining a torsionally stiff coupling between the cam phaser (22) and the concentric camshaft (12), wherein the single unitary flexible body (14*b*) includes a monolithic member connectible at a first radial distance defining at least one first connection point and connectible at a second radial distance defining at least one second connection point, wherein the at least one first and second connection points include a plurality of first and second connection points, wherein the first connection points are spaced at equal arcuate distances angularly with respect to one another and the second connection points are spaced at equal arcuate distances angularly with respect to one other, while the first and second connection points are spaced at non-equal arcuate distances angularly with respect to adjacent ones of the first and second connection points.

10. The improvement of claim 9, wherein the first radial distance is substantially equal to the second radial distance.

* * * * *